US005842232A

United States Patent [19]

Parrish

[11] Patent Number: 5,842,232

[45] Date of Patent: Dec. 1, 1998

[54] PAD INSERTS FOR ENHANCING THE SHAPE OF A WEARER'S BUTTOCKS

[76] Inventor: Janice Ward Parrish, 751 Palm Ave., Boca Raton, Fla. 33432

[21] Appl. No.: 848,032

[22] Filed: Apr. 28, 1997

[51] Int. Cl.[6] ..... A41B 9/00

[52] U.S. Cl. ..... 2/400; 2/406; 2/267; 450/97

[58] Field of Search ..... 2/400, 403, 215, 2/406, 267, 67, 227, 228, 238, 455, 456; 450/97–99; D2/82, 5, 826; D6/608

[56] References Cited

U.S. PATENT DOCUMENTS

| | | | |
|---|---|---|---|
| 2,332,141 | 10/1943 | Greene | 450/97 |
| 2,807,805 | 10/1957 | Allan | 2/400 |
| 3,257,666 | 6/1966 | Hoffman | 2/267 |
| 3,295,530 | 1/1967 | Mayer et al. | 450/97 |
| 3,909,847 | 10/1975 | Holt et al. | 2/455 |
| 4,894,867 | 1/1990 | Cerauolo et al. | 2/238 |
| 4,969,216 | 11/1990 | Guelli | 2/400 |
| 4,984,304 | 1/1991 | Brown | 2/400 |
| 5,103,505 | 4/1992 | Liorens | 2/400 |
| 5,157,789 | 10/1992 | Klass | 2/267 |

*Primary Examiner*—Gloria M. Hale

[57] ABSTRACT

Form-enhancing inserts for use in a garment of the type worn on a wearer's body to cover the lower torso from generally the waistline to the crotch and including the wearer's left and right buttocks. The form-enhancing inserts include first and second buttock pads, each including a central zone, a peripheral zone surrounding the central zone, a concave inner face structured and configured for congruent, mating engagement with the exterior surface configuration of one of the wearer's buttocks, and a convex outer face shaped and configured to define a desired cosmetic buttock profile. The peripheral zone includes an outermost peripheral edge defining a generally egg-shaped configuration. The thickness of each of the buttock pads gradually decreases outwardly from a maximum thickness at the central zone to a minimum thickness at the outermost peripheral edge. Each of the buttock pads are independently stabilized in one of a range of selectively adjusted positions relative to the respective buttock of the wearer.

17 Claims, 2 Drawing Sheets

PAD INSERTS FOR ENHANCING THE SHAPE OF A WEARER'S BUTTOCKS

BACKGROUND OF THE INVENTION

1. Field of the Invention

This invention relates to polyurethane foam pads worn in a panty, girdle, or other like garment for the purpose of enhancing the wearer's figure.

2. Description of the Related Art

Much of the clothing worn by men and women today, and particularly sportswear, conforms exactly to the wearer's body. This type of clothing emphasizes the figure flaw of flat or scant buttocks. A common way to create a more aesthetic form in the buttocks area is by use of padded undergarments.

The prior art includes some undergarments which provide cosmetic pads for the buttocks area such as those of the type shown in U.S. Pat. No. 2,332,141 granted on Oct. 19, 1943 to M. C. Greene for Girdle, and in U.S. Pat. No. 3,295,530 granted on Jan. 3, 1967 to H. Mayer, et al. for Panty Girdle. However, the pads in these garments depend on the compression of the girdle to be "imperceptible through ordinary outer garments." (M. C. Greene) The pads of these garments are not removable or adjustable and the girdles themselves would be quite noticeable under today's skin tight fashions as well as being hot and uncomfortable under active wear.

Other undergarments such as those of the type in U.S. Pat. No. 3,131,698 granted on May 5, 1964 to Patrick J. Morano for Girdle Type Undergarment, in U.S. Pat. No. 4,984,304 granted on Jan. 15, 1991 to James B. Brown, and in U.S. Pat. No. 5,513,393 granted on May 7, 1996 to Robert Ferreira, et al. for Form-Enhancing Device contain a single unit pad which covers both buttocks and does not allow for the independent movement of each buttock, thus causing the movement of one buttock to create an unnatural movement of the other padded buttock.

SUMMARY OF THE INVENTION

Disclosed and claimed herein is a panty with two interior pouches over the buttock area, each pouch containing a foam pad formed to include a convex outer surface and a concave inner surface. The concave inner surface provides a shallow bowl-like pad which fits over the cheek of the buttock area.

An object of this invention is to round out straight or scant buttocks and thus produce a more desirable figure at these points.

A further object of this invention is to ensure that the pads are undetectable from the wearer's body under form fitting clothing and sports wear such as stretch tights and shorts. This object is achieved by the gradually diminishing of thickness from the center of the pads to the edges and by the concave inner surface of the pads. Such concave surface allows the pads to conform to the shape of the body without requiring the compression of a girdle.

It is another object of the invention to provide the wearer with a pair of separate, rounded contour regions in the buttocks area and to allow separate and independent movement of each buttock.

It is another object of the invention to provide the wearer with the versatility of wearing the pads inside the pouches of the panty or inside any other snug fitting inner or outer garment, by allowing the pads to be affixed to such other garments by means of latch loop fasteners.

It is another object of the invention to provide adjustability of the pads to accommodate various figure proportions.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
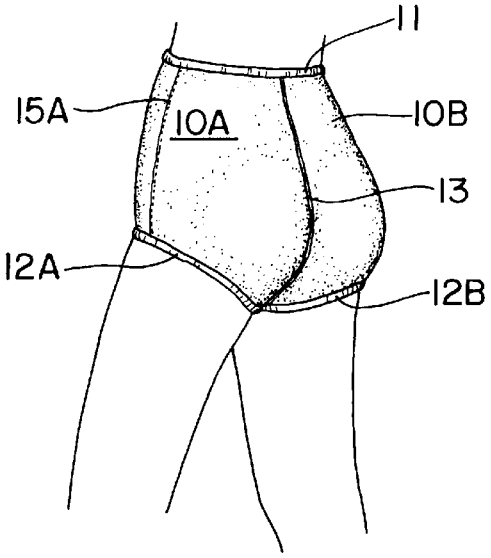
FIG. 1 is a perspective view of a panty worn on a wearer and containing buttock pads of the present invention.
Figure 2:
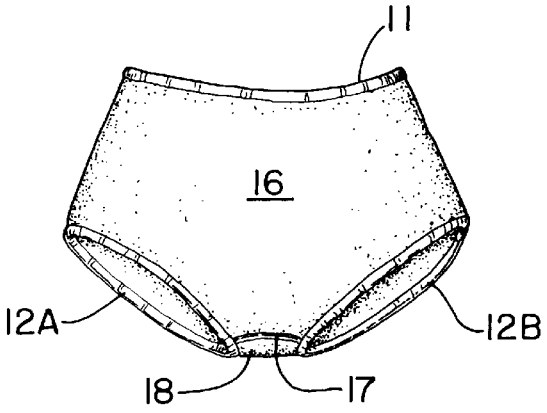
FIG. 2 is a front, elevational view of the panty containing the buttock pads.
Figure 3:
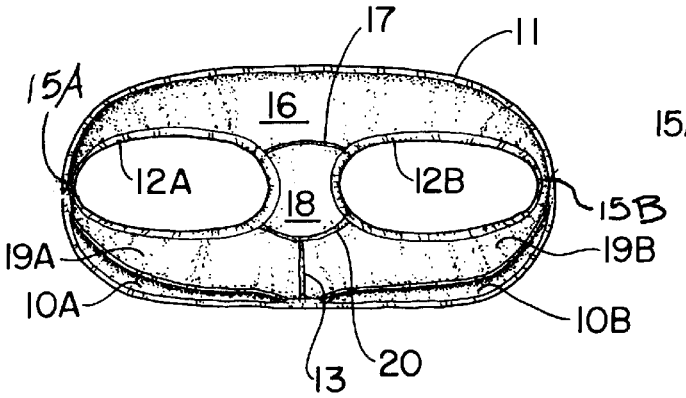
FIG. 3 is a plan view of the panty containing the buttock pads.
Figure 4:
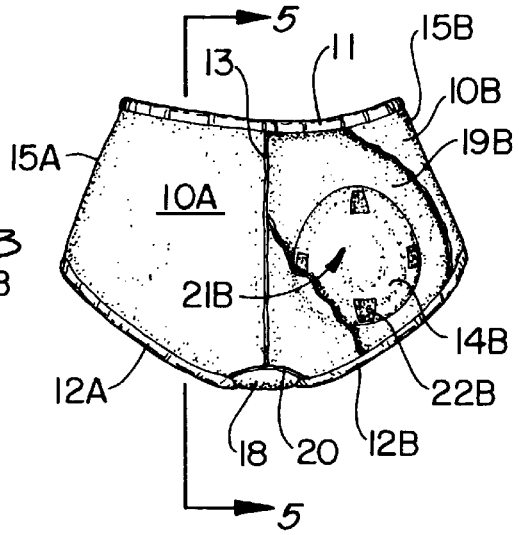
FIG. 4 is a rear view thereof with parts broken away and shown in section to better illustrate the invention.

Referring now to the drawing and in particularly to FIGS. 1, 2 and 3, there is shown a panty. The rear portion of the panty is formed of two rear exterior panel sections 10A and 10B and two rear interior panel sections 19A and 19B. Sections 10A and 10B are stitched together; sections 19A and 19B are stitched together; and sections 10A, 10B are stitched to sections 19A, 19B by a center seam 13. The rear sections 10A and 19A are joined to front section 16 along side seam 15A. The rear sections 10B and 19B are jointed to front section 16 along side seam 15B. The crotch section 18 is joined to front section 16 at seam 17. Exterior rear sections 10A and 10B and interior rear sections 19A and 19B are joined to crotch section 18 at seam 20. An elastic leg band 12A is stitched to the leg opening formed by the lower right edge of front section 16, crotch section 18 and the lower edges of rear sections 10A and 19A. An elastic leg band 12B is stitched to the leg opening formed by the lower left edge of front section 16, crotch section 18 and the lower edges of rear sections 10B and 19B. An elastic waistband 11 is stitched to the top edge of front section 16 and the top edge of exterior sections 10A and 10B. The top edges of interior, rear sections 18A and 19B are not stitched to the waistband, but are left open to form openings to the pouches between the rear exterior section 10A and rear interior section 19A and between rear, exterior section 10B and rear interior section 19A. These two pouches, which are kept separate by center seam 13, allow for the interior of a respective one of two carved polyurethane foam pads 21A, 21B, each of which may be adjustably positioned within its pouch.

Figure 5:
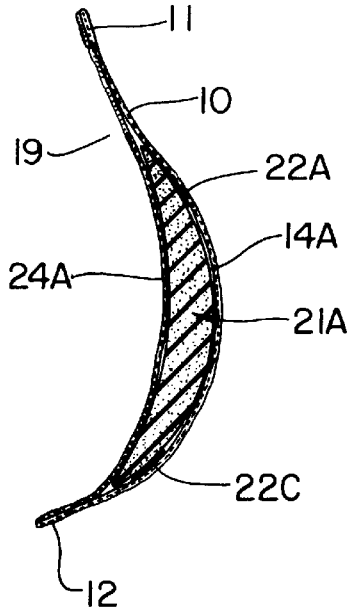
FIG. 5 is a cross-sectional view thereof taken on line 5—5 of FIG. 4.
Figure 6:
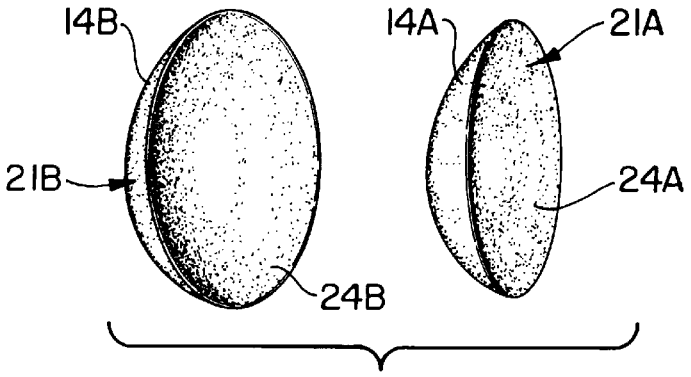
FIG. 6 is a perspective view of the interior surface of the buttock pads.
Figure 7:
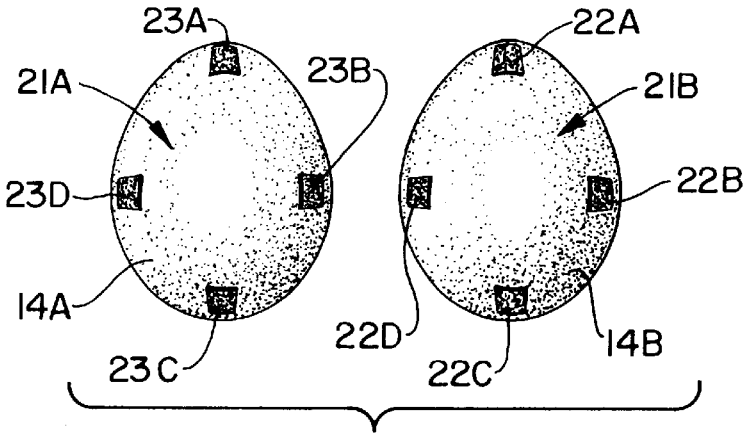
FIG. 7 is an elevational view of the exterior surface of the buttock pads.

In FIGS. 4–7, there is shown two carved pads 21A and 21B formed of polyurethane foam, each pad being a mirror image of the other. The pads have concave interior surfaces 24A and 24B (as shown in FIG. 6), which are generally congruent to the exterior cheek configuration of each buttock, allowing them to follow the curve of the body, in mating relation therewith, thus fitting the buttocks without a perceptible line of demarcation between each pad 21A, 21B and the respective buttock under any opaque garment. The exterior surface 14A and 14B of the pads (as shown in FIG. 5) are convex to add profile to the buttocks. As can be seen in FIG. 7, the pads are shown with latch loop fasteners 22A, 22B, 22C, 22D, 23A, 23B, 23C and 23D attached to the top, bottom and both sides of the exterior surface of the pads. The fasteners serve to secure the pads in the pouches of the panty, and to enable the pads to be fastened to the seat portion of other garments as well. This system of fastening also allows the wearer to adjust the pads to best fit the individual's figure and preferred look.

The undergarment and pads of the present invention have been described with reference to certain embodiments and exemplifications thereof. Doubtless other designs and variations could occur to one skilled in the art by utilizing the teachings of the present invention. For example, although depicted as panties, the undergarment used in connection with the present invention may take the form of any conventionally-known undergarment or snug fitting garment such as, but not limited to, a girdle extending from above the waist to the knee. The pads may be made of an open cell foam for dry clothing or a closed cell foam for bathing wear and may be coated with a waterproof material as another embodiment for bathing wear. The pads may be encased in a fabric cover or flocked. The pads may be encased in interior pockets within an undergarment, which pockets correspond to the perimeter of the pads without the use of latch loop fasteners. Such design variations are considered to be within the scope of the adept and are not a departure from the scope of the present invention as defined in the following claims.

What is claimed is:

1. An undergarment adapted to be worn on a wearer's body to cover the lower torso from generally the waistline to the crotch and including the wearer's left and right buttocks, wherein each of the wearer's buttocks includes an exterior surface configuration, said undergarment comprising:

a rear portion, a frontal portion, a crotch portion, a waistband and a pair of leg openings;

said rear portion including an exterior panel structure having a first exterior panel and a second exterior panel;

said rear portion further including an interior panel structure having a first interior panel and a second interior panel;

said first and second exterior panels and said first and second interior panels being joined to said crotch section and being further joined along a common central rear seam from said crotch section to said waistband, said first exterior panel and said first interior panel being joined to said frontal portion along a first side seam and said second exterior panel and said second interior panel being joined to said frontal panel along a second side seam opposite said first side seam;

said first exterior panel and said first interior panel being disposed in overlying relation to one another to define a first pouch and said second exterior panel and said second interior panel being disposed in overlying relation to one another to define a second pouch; and first and second buttock pads each including a central zone, a peripheral zone surrounding said central zone, said peripheral zone including an outermost peripheral edge, a concave inner face structured and configured for congruent, mating engagement with the exterior surface configuration of one of the wearer's buttocks, and a convex outer face shaped and configured to define a desired cosmetic buttock profile, a thickness of each of said buttock pads gradually decreasing outwardly from a maximum thickness at said central zone to a reduced thickness at said surrounding peripheral zone, and a minimum thickness at said outermost peripheral edge, and said buttock pads being sized for removable receipt within a respective one of said first and second pouches.

2. An undergarment as recited in claim 1 further including stabilizing means for holding and maintaining each of said buttock pads in one of a plurality of selectively adjusted positions against one of the respective buttocks of the wearer.

3. An undergarment as recited in claim 2 wherein said stabilizing means includes hook and loop fastening means.

4. An undergarment as recited in claim 1 wherein said buttock pads are formed of a resilient foam material.

5. An undergarment as recited in claim 1 wherein said outermost peripheral edge defines a generally egg-shaped configuration.

6. An undergarment adapted to be worn on a wearer's body to cover the lower torso from generally the waistline to the crotch and including the wearer's left and right buttocks, wherein each of the wearer's buttocks includes an exterior surface configuration, said undergarment comprising:

a rear portion, a frontal portion, a crotch portion, a waistband and a pair of leg openings;

first and second buttock pads each including a central zone, a peripheral zone surrounding said central zone, said peripheral zone including an outermost peripheral edge, a concave inner face structured and configured for congruent, mating engagement with the exterior surface configuration of one of the wearer's buttocks, and a convex outer face shaped and configured to define a desired cosmetic buttock profile, a thickness of each of said buttock pads gradually decreasing outwardly from a maximum thickness at said central zone to a reduced thickness at said surrounding peripheral zone and a minimum thickness at the outermost peripheral edge; and stabilizing means for holding and maintaining each of said buttock pads on said rear portion of said undergarment in one of a plurality of selectively adjusted positions relative to the buttocks of the wearer.

7. An undergarment as recited in claim 6 wherein said stabilizing means includes hook and loop fastening means.

8. An undergarment as recited in claim 6 wherein said buttock pads are formed of a resilient foam material.

9. An undergarment as recited in claim 6 wherein said outermost peripheral edge defines a generally egg-shaped configuration.

10. Form-enhancing inserts for use in a garment of the type worn on a wearer's body to cover the lower torso from generally the waistline to the crotch and including the wearer's left and right buttocks, wherein each of the wearer's buttocks includes an exterior surface configuration, said form-enhancing inserts comprising:

first and second buttock pads, each including a central zone, a peripheral zone surrounding said central zone, said peripheral zone including an outermost peripheral edge, a concave inner face structured and configured for congruent, mating engagement with the exterior surface configuration of one of the wearer's buttocks, and a convex outer face shaped and configured to define a desired cosmetic buttock profile, a thickness of each of said buttock pads gradually decreasing outwardly from a maximum thickness at said central zone to a reduced thickness at said surrounding peripheral zone and a minimum thickness at said outermost peripheral edge; and stabilizing means for holding and maintaining each of said buttock pads in one of a plurality of selectively adjusted positions relative to the buttocks of the wearer.

11. Form-enhancing inserts as recited in claim 10 wherein said first and second buttock pads are formed of a resilient foam material.

12. Form-enhancing inserts as recited in claim 11 wherein said resilient foam material is of an open cell structure.

13. Form-enhancing inserts as recited in claim 11 wherein said resilient foam material is of a closed cell structure.

14. Form-enhancing inserts as recited in claim 11 wherein said first and second buttock pads include an outer, liquid impervious coating.

15. Form-enhancing inserts as recited in claim 10 wherein said garment is an undergarment.

16. Form-enhancing inserts as recited in claim 10 wherein said garment is a bathing suit.

17. Form-enhancing inserts as recited in claim 10 wherein said garment is snug fitting and worn against the skin of the wearer.

* * * * *